US007866520B2

(12) United States Patent
Lin

(10) Patent No.: US 7,866,520 B2
(45) Date of Patent: Jan. 11, 2011

(54) STAPLE GUN WITH A SAFETY DEVICE AND ITS SAFETY DEVICE

(75) Inventor: Wen-Pin Lin, Taichung Hsien (TW)

(73) Assignee: Acuman Power Tools Corp., Taichung Hsien (TW)

( * ) Notice: Subject to any disclaimer, the term of this patent is extended or adjusted under 35 U.S.C. 154(b) by 175 days.

(21) Appl. No.: 12/359,340

(22) Filed: Jan. 25, 2009

(65) Prior Publication Data

US 2010/0187278 A1 Jul. 29, 2010

(51) Int. Cl.
*B27F 7/17* (2006.01)

(52) U.S. Cl. ..... 227/8; 227/131; 227/132

(58) Field of Classification Search ..... 227/8, 227/107, 131, 132, 134, 110, 119
See application file for complete search history.

(56) References Cited

U.S. PATENT DOCUMENTS 3,950,721 A * 4/1976 Manganaro ..... 335/278
4,417,681 A * 11/1983 Bernecki et al. ..... 227/8
5,118,023 A * 6/1992 Fushiya et al. ..... 227/8
6,955,281 B1 * 10/2005 Wei ..... 227/2
6,971,567 B1 * 12/2005 Cannaliato et al. ..... 227/2

* cited by examiner

*Primary Examiner*—Rinaldi I. Rada
*Assistant Examiner*—Nathaniel Chukwurah
(74) *Attorney, Agent, or Firm*—Banger Shia

(57) ABSTRACT

A staple gun with a safety device and its safety device are disclosed. The staple gun with a safety device comprises a safety device and a staple-floating unit that are installed in a housing of the staple gun. The safety device includes a safety push sheet and a switch. In a middle portion of the safety push sheet is defined an engaging slot along a staple-discharging direction, and the safety push sheet is further provided with a triggering sheet extending from an upper end thereof. The staple-floating unit is movably connected to the safety device and includes a guide sheet, a control knob, and a positioning pin. The positioning pin can be used to drive the safety push sheet and the guide sheet to move downwards to make the safety push sheet and the guide sheet to protrude out of the staple exit synchronously for facilitating exerting the staple-floating function.

5 Claims, 12 Drawing Sheets

STAPLE GUN WITH A SAFETY DEVICE AND ITS SAFETY DEVICE

BACKGROUND OF THE INVENTION

1. Field of the Invention

The present invention relates to a staple gun; and more particularly to a staple gun with a safety device and its safety device which can prevent the staples from being discharged by mistake.

2. Description of the Prior Art

Commonly, all staple guns applicable for U-shaped staples are almost light and operated in such a way that the staple exit is made to abut against a plane first, and then the control handle will be pressed to discharge a staple. In recent years, in order to be applicable to the planes with other objects (for example, wire), a conventional staple gun with a staple-floating function was developed on the market, such as the staple gun disclosed in U.S. Pat. No. 6,131,788.

The staple gun disclosed in U.S. Pat. No. 6,131,788 is interiorly provided with a guide device to be operated to guide a guide element toward a staple exit to extend out of the staple gun a predetermined distance. The guide element is defined with a U-shaped notch at a distal end thereof to surround an object like wire, so that a control handle can be used to discharge the staple to surround the wire in such a manner that the two legs of the staple are pressed into the plane where the wire abuts, thus making the staple stand on the plane in a reverse U manner, which is called the staple-floating function. If the staple-floating function is unneeded, the guide device can be operated to retract the guide element into the staple exit of the staple gun.

Although the conventional staple gun has a staple-floating fixing function, such a staple gun having both a staple-floating function and a flat-stapling function (the flat-stapling function means that when a staple is fixed into a pre-determined plane by the staple gun, the staple will abut against the predetermined plane) lacks of a safety structure to ensure the staple to be discharged safely and prevent the staples from being discharged by mistake.

The present invention has arisen to mitigate and/or obviate the afore-described disadvantages.

SUMMARY OF THE INVENTION

The primary objective of the present invention is to provide a staple gun with a safety device, which utilizes the safety device to prevent the staples from being discharged by mistake.

In order to achieve the above objective, a staple gun with a safety device in accordance with the present invention comprises a housing combined by two symmetrical half-housing bases. The housing is defined with a staple exit in a bottom surface thereof and an inner chamber adjacent to the staple exit. The staple exit is in communication with the inner chamber. The inner chamber is provided with a safety device and a staple-floating unit.

The safety device includes a safety push sheet and a switch, a lower end of the safety push sheet extends out of the staple exit, in a middle portion of the safety push sheet is defined an engaging slot along a staple-discharging direction, the safety push sheet is further provided with a triggering sheet at an upper end thereof, the inner chamber is provided with a switch corresponding to the triggering sheet in such a manner that the contact moves upwards with the safety push sheet to turn on the switch to transmit a staple-discharging signal.

The staple-floating unit includes a guide sheet, a control knob, a positioning pin, one end of the guide sheet extends out of the staple exit, a middle portion of the guide sheet is provided with a linkage sheet for penetrating the engaging slot, the other end of the guide sheet cooperates with the safety push sheet to pull both ends of an elastic element in such a manner that the safety push sheet is movably connected to the guide sheet, the guide sheet is provided with a pair of fins above the elastic element, each of the fins includes an elongated transverse hole for penetration of the positioning pin.

The housing is defined with an insertion hole corresponding to the staple-floating unit in such a manner that the control knob is elastically installed in the insertion hole to advance/retreat along the elongated hole, the control knob is located between the two fins, the control knob is defined with a through hole in alignment with the elongated hole for penetration of the positioning pin, both ends of the positioning pin, which penetrate the guide sheet, are limited by the housing, so that the control knob is guided to advance/retreat along the elongated hole, and the positioning pin drives the safety push sheet and the guide sheet to move up and down to enable the safety push sheet and the guide sheet to protrude out of the staple exit, so that the staple gun is able to apply a floating staple.

Further analysis shows that the present invention has the following advantages:

1. The present invention utilizes the safety push sheet to contact the appointed surface first, and then a counter-acting force of contacting the appointed surface will turn on the switch to transmit a disc-discharging signal, thus effectively improving the safety and preventing the staples from being discharged by mistake.

2. The staple-floating unit is movably connected to the safety device of the present invention, so that when the staple gun is used to drive staples into a plane, the guide sheet keeps in a static state without being driven by the safety device to move, in addition, if the staple gun is used to exert the staple-floating function, through the cooperation of the positioning pin and the limiting grooves, the control knob will perform three segments of movement: first, guiding the positioning pin to the start position of the synchronous movement of the safety push sheet and the guide sheet, namely the control knob drives the positioning pin to one end of the elongated hole; second, the positioning pin will linearly move downwards along the limit grooves to cause the safety push sheet and the guide sheet to move synchronously; third, when the guide sheet protrudes out of the staple exit and the staple gun is ready to exert the staple-floating function, the control knob will be pushed back to move transversely to ensure the guide sheet to be positioned, and the safety push sheet is still brought into contact with the appointed surface earlier than the guide sheet to exert the safety function. The staple-floating unit and the safety device of the present invention have no influence on each other and both are installed in the limit space in the staple gun to make the safety device to exert the safety function substantially.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
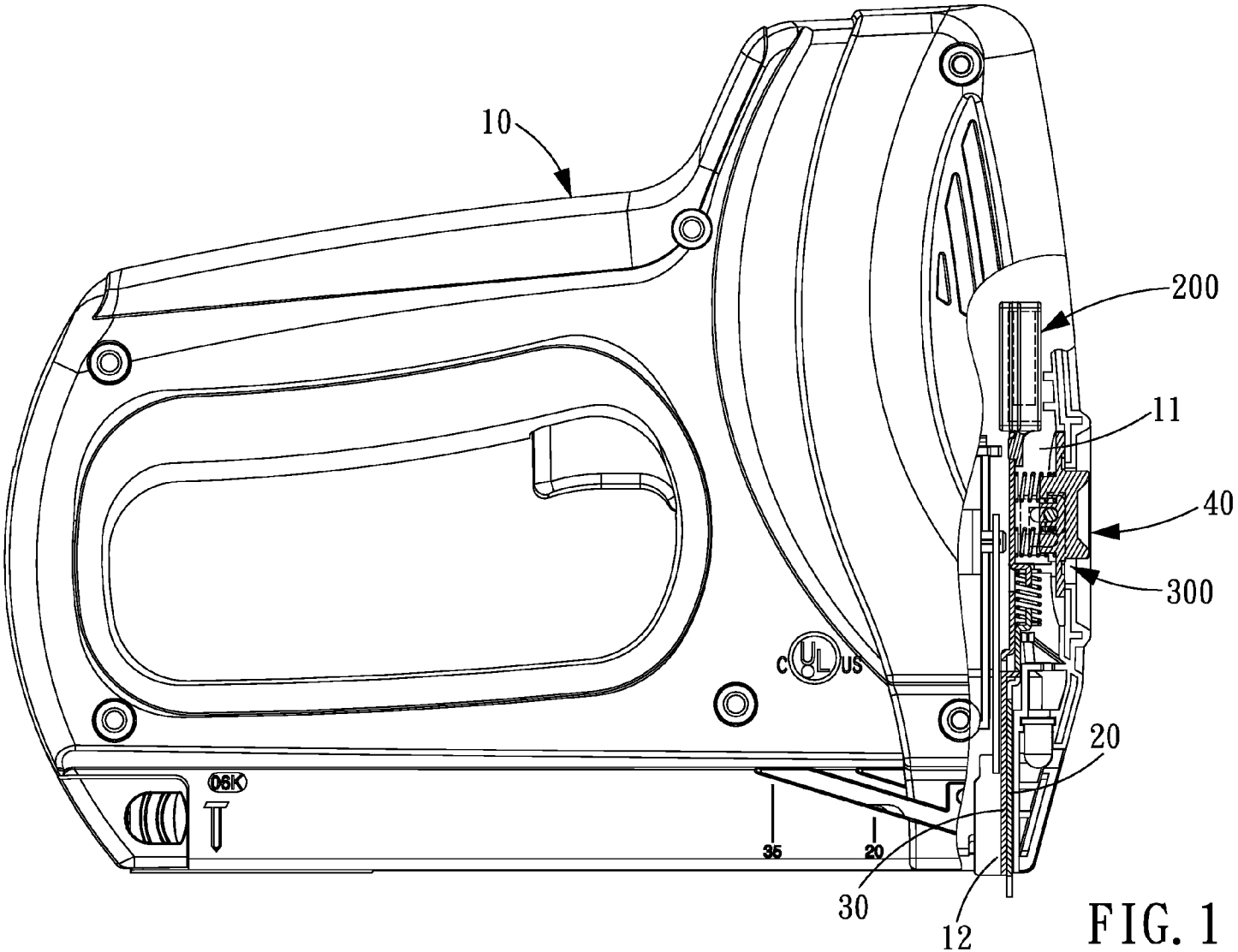
FIG. 1 is a side view of a staple gun with a safety device in accordance with the present invention.

Referring to FIG. 1, a staple gun with a safety device in accordance with the present invention comprises a housing 10, an inner chamber 11 in one side of the housing 10, and a staple exit 12 disposed in the lower surface of the housing 10. The staple exit 12 is in communication with the inner chamber 11. The present invention is characterized in that the inner chamber 11 is provided with a safety device 200 and a staple-floating unit 300.

Figure 2:
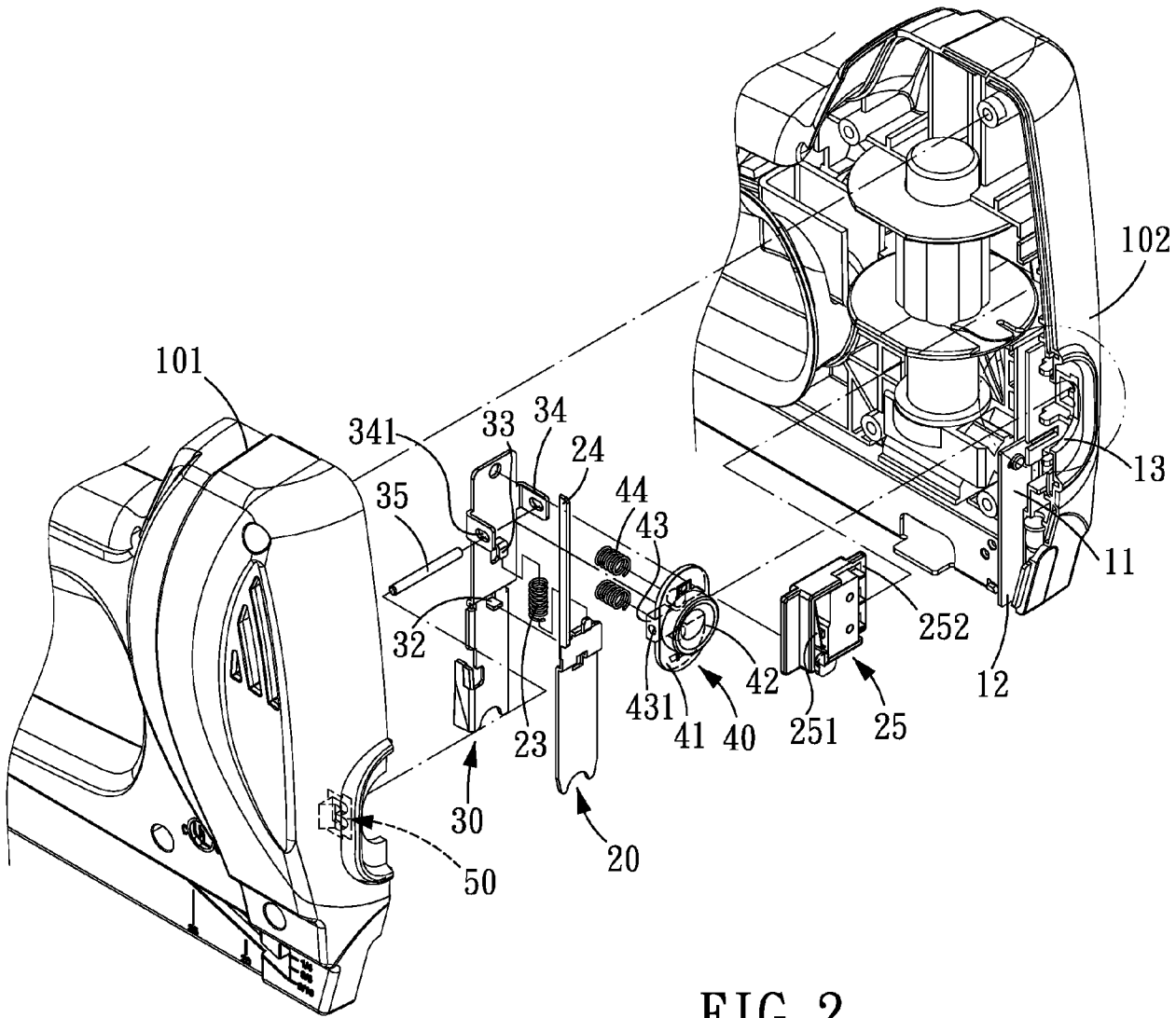
FIG. 2 is an exploded view of the staple gun with a safety device in accordance with the present invention.

As shown in FIGS. 1-2, the housing 10 includes two combined symmetrical half-housing bases 101, 102, so the inner chamber 11, the staple exit 12 each are also defined by two symmetrical spaces in the two housing bases 101, 102. The housing 10 is provided with in an end surface thereof with an elongated insertion hole 13 defined by the two half-housing bases 101, 102. The insertion hole 13 is in communication with the inner chamber 11.

Figure 3:
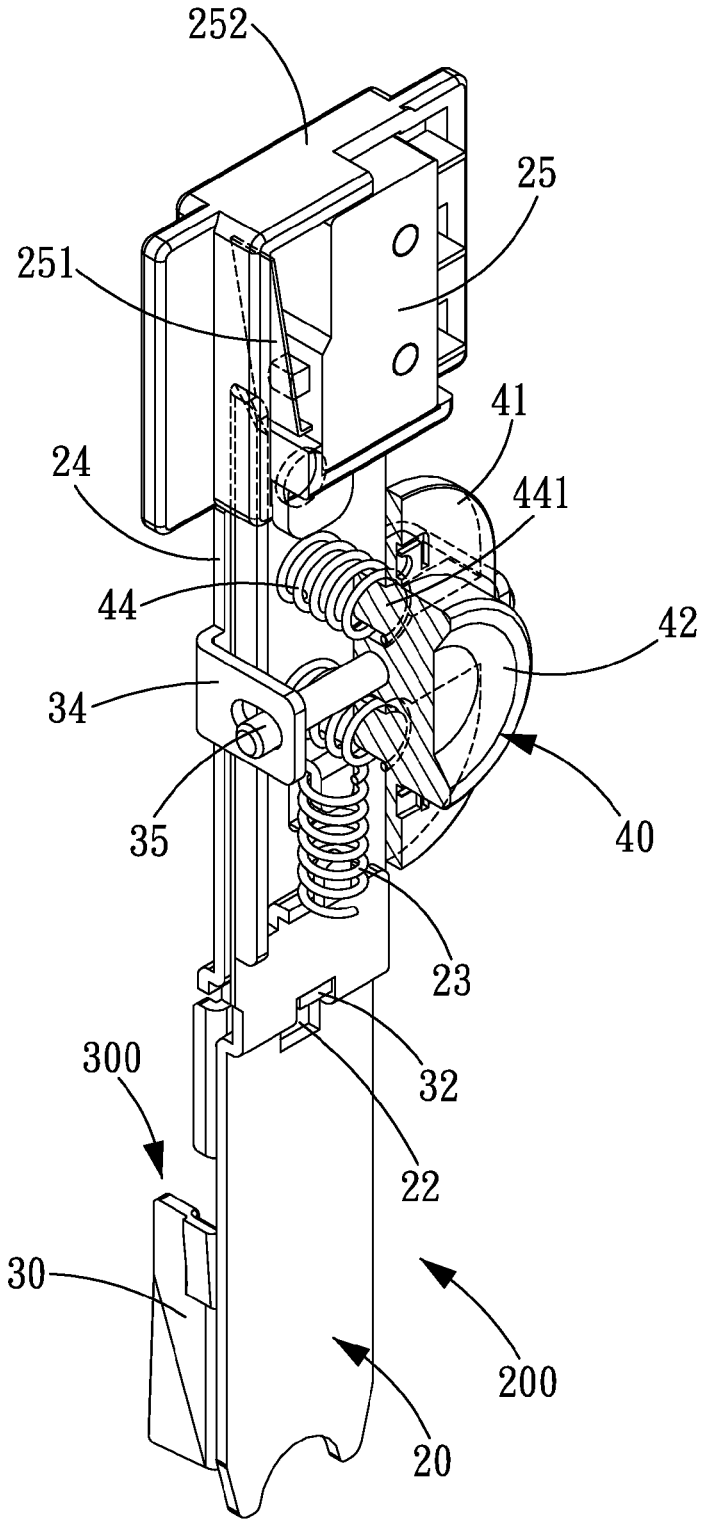
FIG. 3 is a combination view of a safety device and a staple-floating unit of the present invention.
Figure 4:
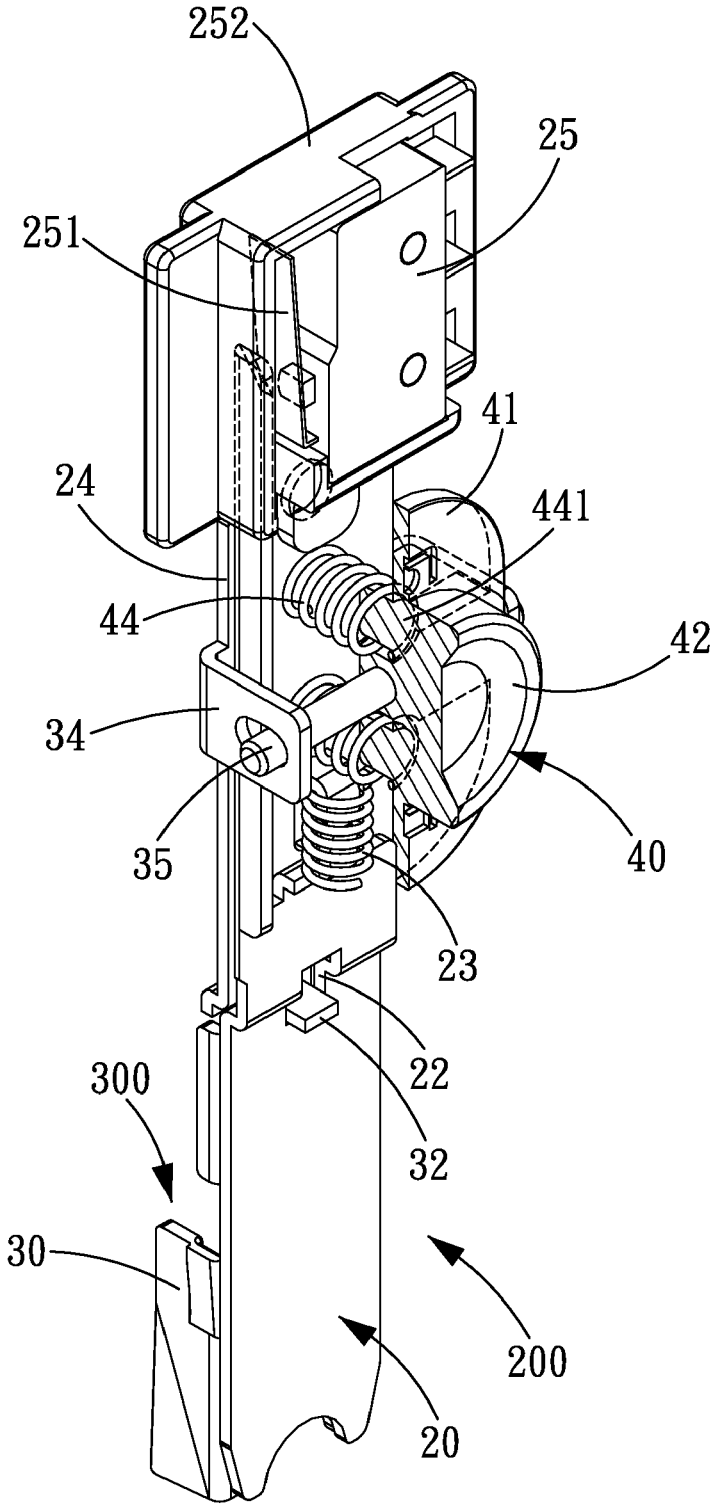
FIG. 4 is a perspective view illustrating that the safety device in accordance with the present invention is brought into contact with the switch to turn on the switch.

The safety device 200 includes a safety push sheet 20 and a switch 25. As shown in FIGS. 2-3, the safety push sheet 20 is provided with an arc notch in a lower end thereof, an elongated engaging slot 22 in the middle portion thereof along a staple-discharging direction, and a hooking portion located at an upper side of the engaging groove for hooking on one end of an elastic element 23. A long triggering sheet 24 is extended from the safety push sheet 20 and located at one side of the elastic element 23. The switch 25 is a micro switch. The switch 25 is provided at one side thereof with a starting piece 251 to be triggered by the triggering sheet 24. The switch 25 is disposed in a seat 252 which is fixedly located on a side wall of the inner chamber 11. As shown in FIGS. 3-4, the safety push sheet 20 can move up and down for releasing or activating the starting piece 251 to make the switch 25 to send out a staple-discharging signal while the switch 25 is turned on or a safety signal while the switch 25 is turned off to a staple transmission system (not shown) in the staple gun.

The staple-floating unit 300 includes a guide sheet 30, a control knob 40, a positioning pin 35 and two limit grooves 50 in the inner chamber 11. One end of the guide sheet 30, which is U-shaped in cross section, is defined with an arc notch toward the staple exit 12. The guide sheet 30 is provided with a linkage sheet 32 transversely protruding from a middle portion thereof and a pull hook 33 on the other end thereof for hooking at the other end of the elastic element 23. The guide sheet 30 is further provided with two opposite fins 34 above the pull hook 33 in such a manner that the two fins 34 are located opposite the two housing bases 101, 102. Each of the fins 34 is transversely defined with an elongated slot 341 for penetration of the positioning pin 35, so that the staple-floating unit 300 can be movably connected to the safety device 200.

The control knob 40 installed in the insertion hole 13 includes an elliptic disc portion 41 and a knob portion 42 protruding from a center of the disc portion 41. The disc portion 41 is located on the inner side wall of the inner chamber 11 while only the knob portion 42 extends out of the insertion hole 13. The knob portion 42 can move up and down along the insertion hole 13. The disc portion 41 is further provided with a lateral portion 43 protruding from one side thereof opposite the guide sheet 30, and the lateral portion 43 is defined with a transverse through hole 431 in alignment with the elongated slots 341 for penetration of the positioning pin 35. The disc portion 41 of the control knob 40 is provided with a pillar portion 441 protruding toward a back side of the guide sheet 30, so that the pillar portion 441 and the back side of the guide sheet 30 can hook at both ends of a spring 44, so that the control knob 40 can elastically advance and retreat with respect to the guide sheet 30.

Figure 5:
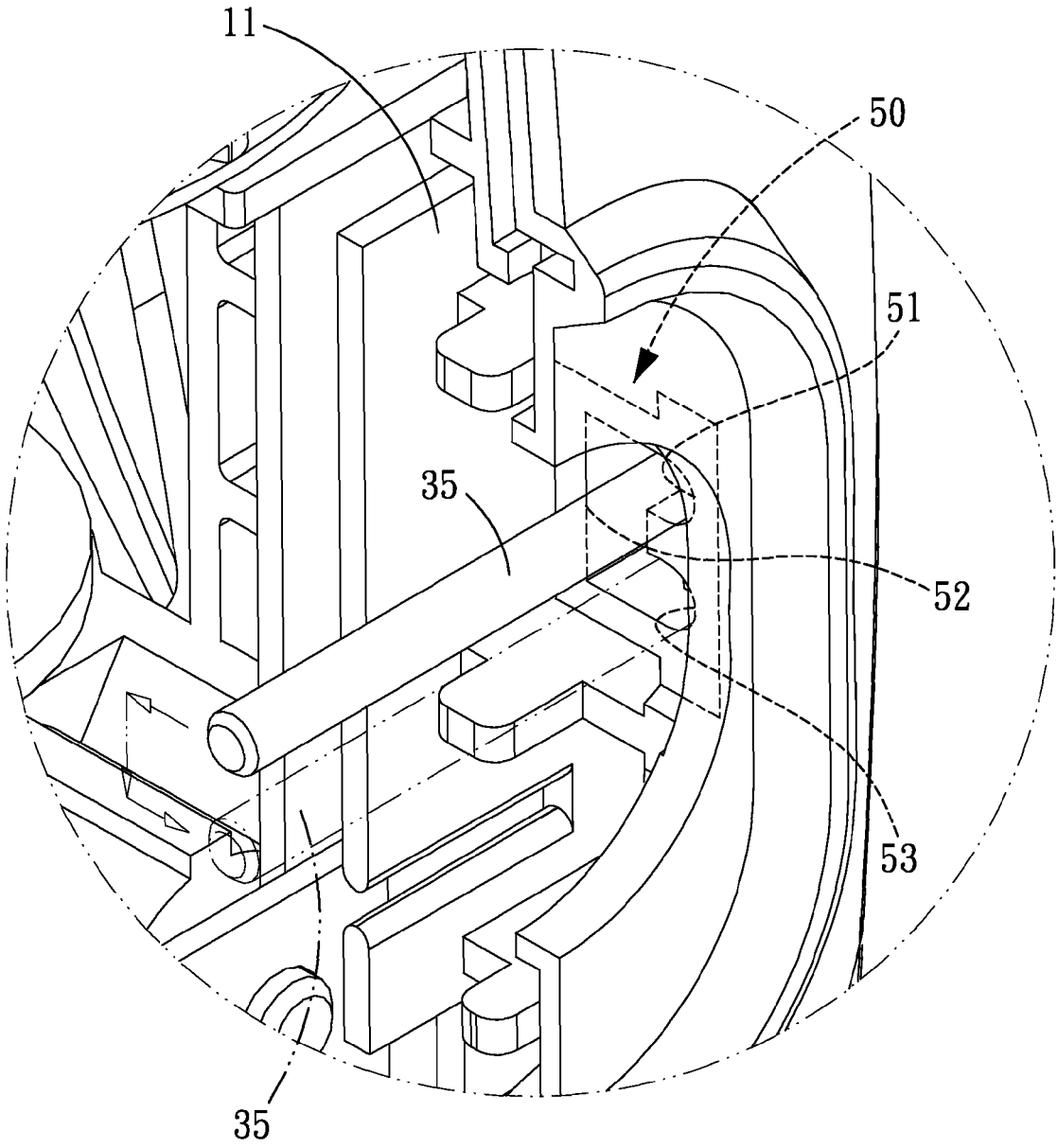
FIG. 5 is a perspective view illustrating the relationship between the positioning pin and the limit groove in accordance with the present invention.
Figure 6:
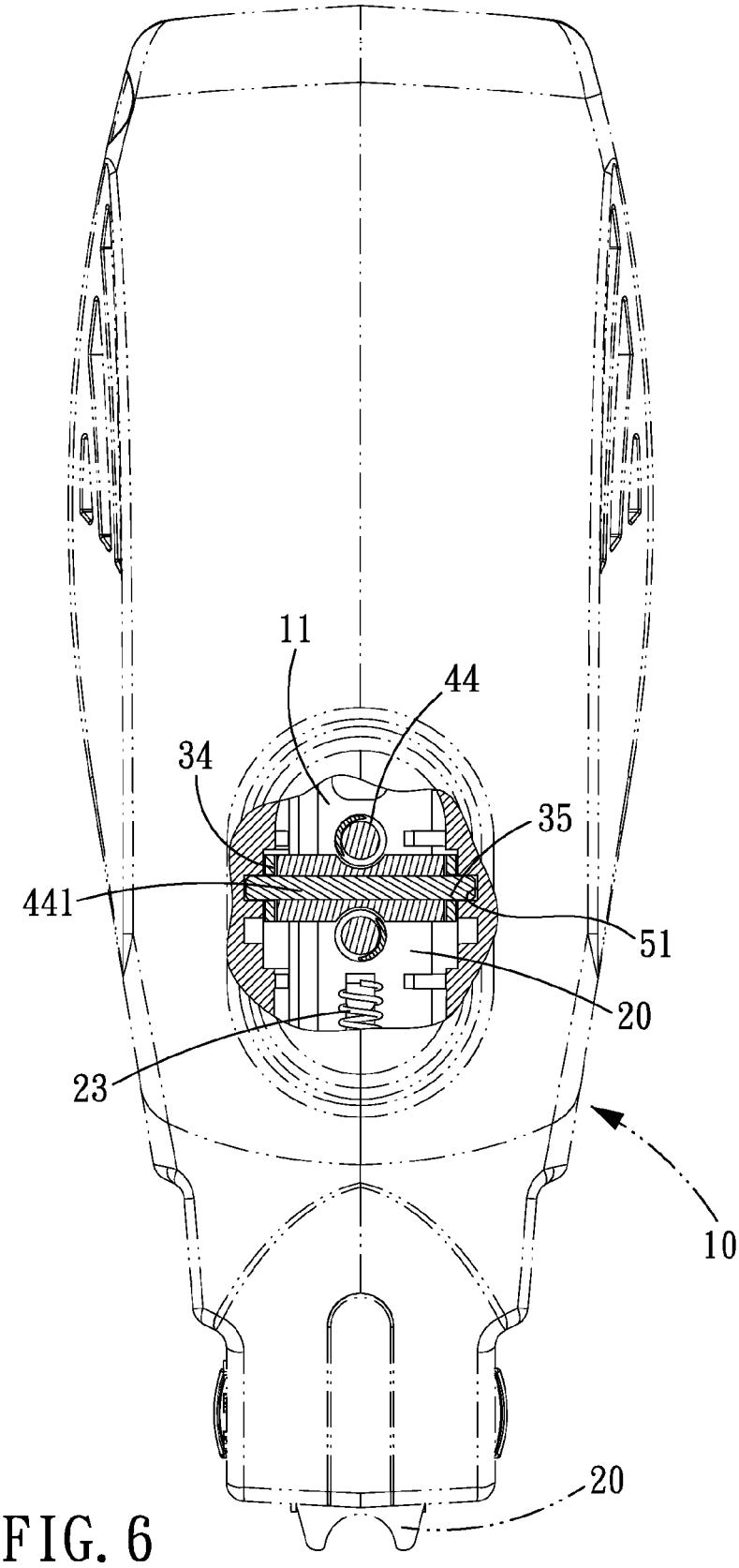
FIG. 6 is a top plane view illustrating the relationship between the positioning pin and the limit groove in accordance with the present invention.

The limit grooves 50 are located in the inner walls of the respective two half-housing bases 101, 102. As shown in FIGS. 2 and 5, each of the limit grooves 50 is in the form of a laterally-opened U-shaped groove and includes three segments: a first segment 51 which is transversely arranged at the upper side of the limit groove 50, a second segment 52 which is longitudinally arranged in the middle portion of the limit groove 50, and a third segment 53 which is transversely arranged at the lower side of the limit groove 50 and parallel to the first segment 51. The second segment 52 is in a vertical communication with the first segment 51 and the third segment 53. As shown in FIGS. 3, 5 and 6, both ends of the positioning pin 35 which penetrates both the guide sheet 30 and the control knob 40 normally enter the first segments 51 of the limit grooves 50, and due to the spring 44, the positioning pin 35 is closely located against the inner side edges of the first segments 51. As shown in FIG. 3, normally, the triggering sheet 24 of the safety push sheet 20 is not in contact with the starting piece 251 while the bottom end of the safety push sheet 20 protrudes with respect to the bottom end of the guide sheet 30, and the linkage sheet 32 abuts against the inner upper side of the engaging slot 22.

Figure 7:
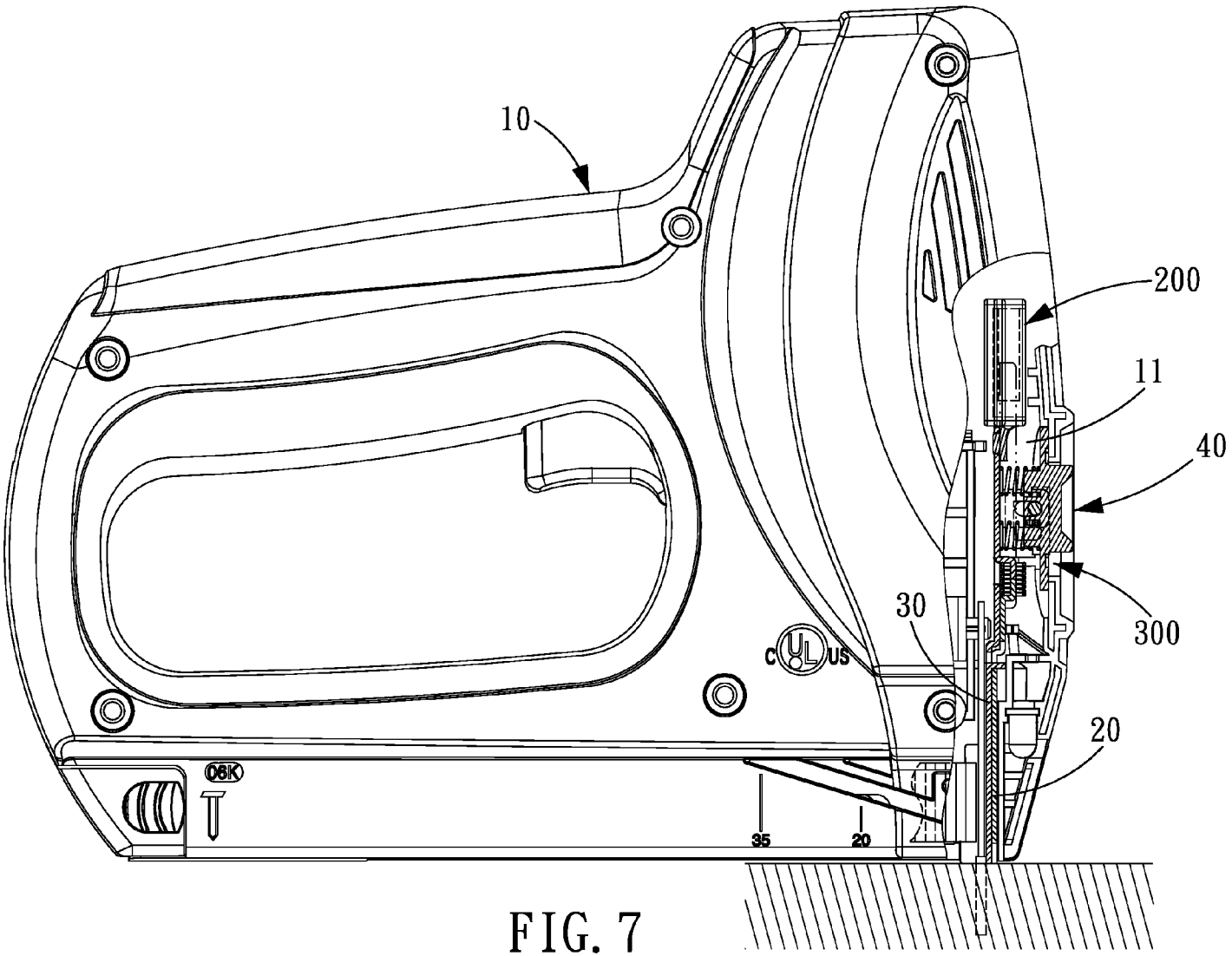
FIG. 7 is a side view illustrating how the staple gun in accordance with the present invention exerts the flat-stapling function.

Referring to FIGS. 1 and 7 which illustrate how the staple gun of the present invention exert a normal flat-stapling function, at this moment, the guide sheet 30 is retracted into the staple exit 12, so that the safety push sheet 20 will be brought into contact with an appointed staple-positioning surface first. As shown in FIGS. 3-4, the counter-acting force of contacting the appointed staple-positioning surface will cause the engaging slot 22 of the safety push sheet 20 to move upwards along the linkage sheet 32, so that when the staple gun of the present invention exerts the flat-stapling function, the operation of the safety push sheet 20 will has no influence on the guide sheet 30. With such arrangements, when the triggering sheet 24 is brought into contact the starting piece 251, the switch 25 will be turned on to transmit a staple-discharging signal, then the user can discharge the staple out of the staple gun. Since the guide sheet 30 is retracted into the staple exit 12, the staples can be still discharged out of the staple gun along the guide sheet 30 and then driven into the appointed surface to abut against the appointed surface. After the staple is discharged out of the staple gun, and the staple gun releases from the appointed surface, under the action of the restoring force of the elastic element 23, the safety push sheet 20 will move downwards to restore to its original state of being in no contact with the starting piece 251.

Figure 8:
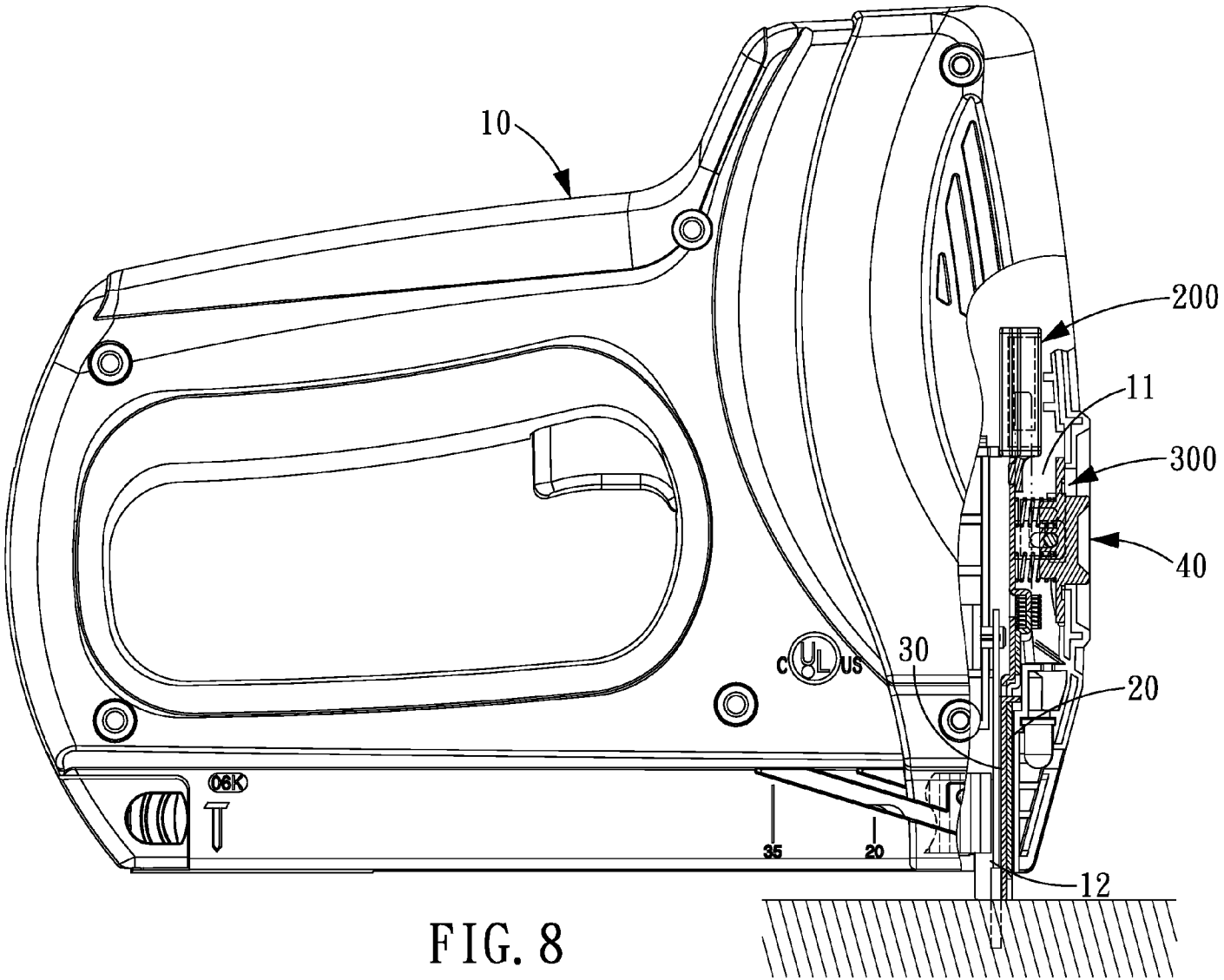
FIG. 8 is a side view illustrating how the staple gun in accordance with the present invention exerts the staple-floating function.
Figure 9:
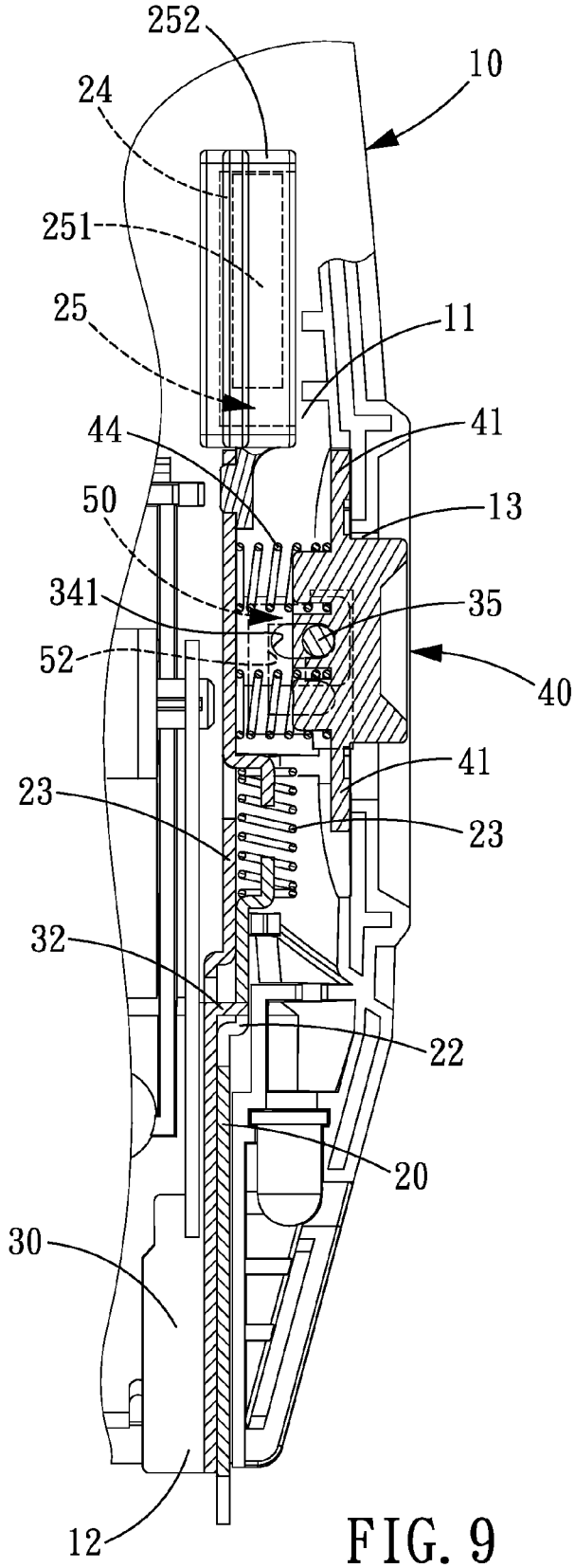
FIG. 9 is an enlarged cross-sectional view of the staple gun with a safety device in accordance with the present invention.
Figure 10:
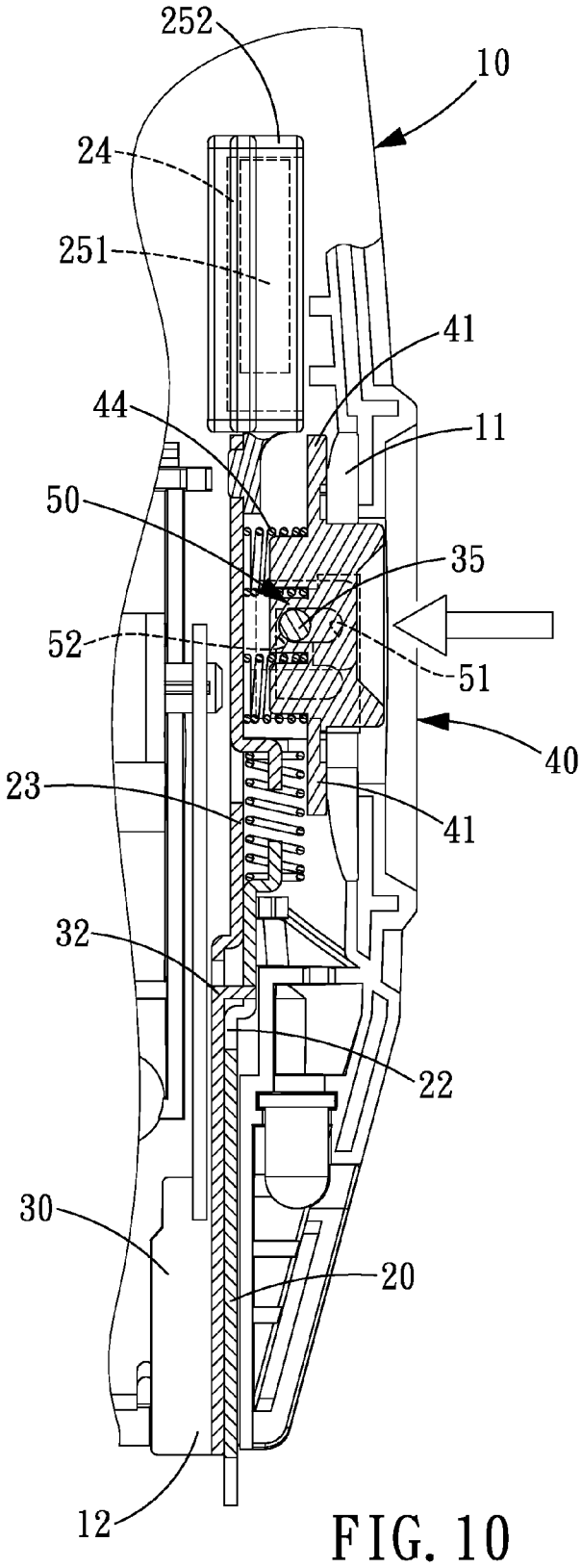
FIG. 10 is a first enlarged cross-sectional view of the staple-floating unit in accordance with the present invention.
Figure 11:
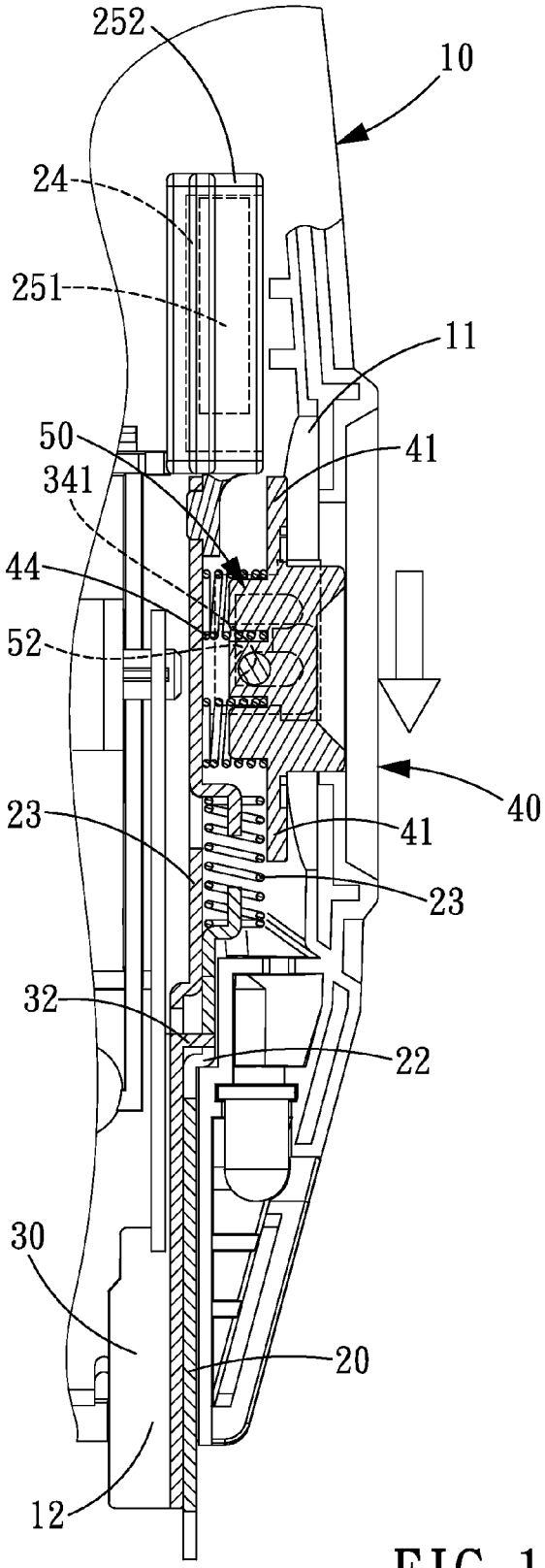
FIG. 11 is a second enlarged cross-sectional view of the staple-floating unit in accordance with the present invention.
Figure 12:
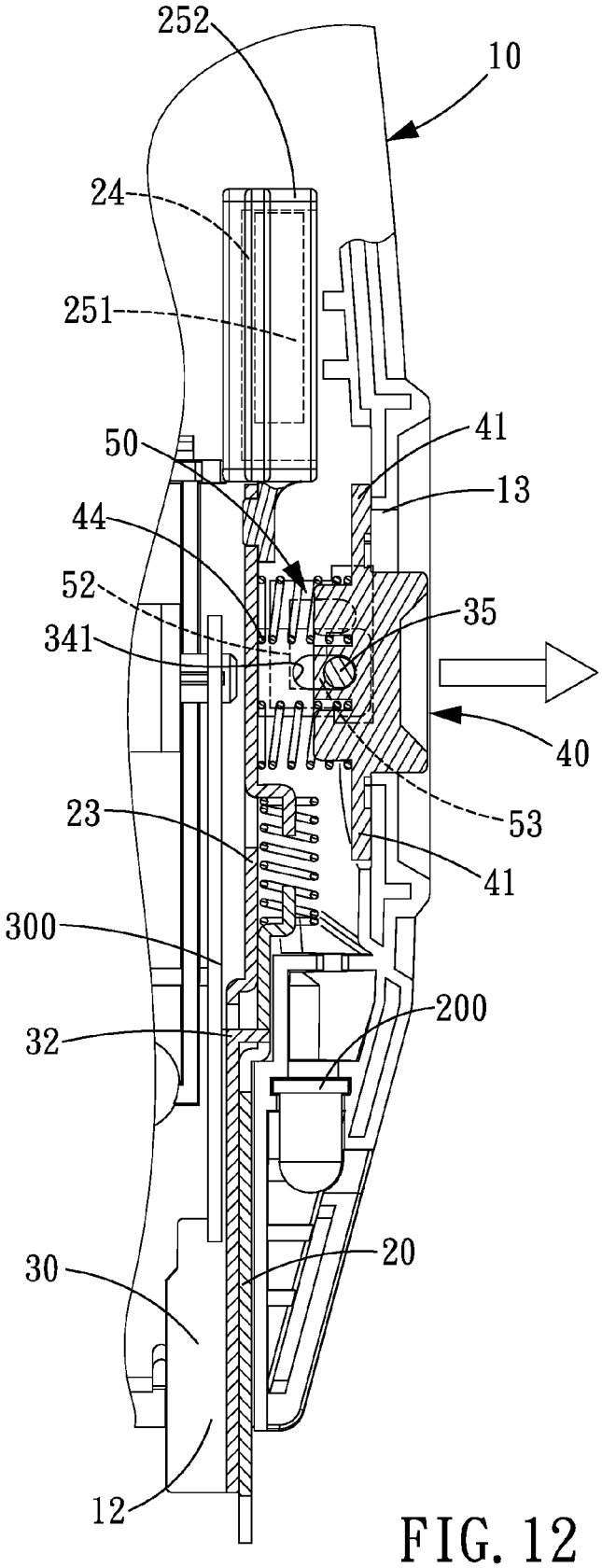
FIG. 12 is a third enlarged cross-sectional view of the staple-floating unit in accordance with the present invention.

Referring to FIGS. 1 and 8 illustrating how the staple gun of the present invention exerts a staple-floating function, and next referring to FIGS. 9-12, FIG. 9 shows the staple gun of the present invention is in a normal non-operating state, and FIGS. 9-10 show that as long as the control knob 40 is pressed down to compress the spring 44, at this moment the disc portion 41 will leave away from the side wall of the inner chamber 11, and the control knob 40 will drive the positioning pin 35 to move horizontally along the first segments of the limit grooves 50. As shown in FIGS. 11-12, when the positioning pin 35 reaches the second segments 52, the control knob 40 will continue moving downwards along the insertion hole 13 to make the positioning pin 35 move longitudinally downwards along the second segments 52. Especially, such a downward movement (please refer to FIG. 4) will make the linkage sheet 32 press against the inner periphery of the engaging slot 22 to drive the safety push sheet 20 to move synchronously. Since the positioning pin 35 drives the guide sheet 30 and the safety push sheet 20 to move downwards, it can be seen that the guide sheet 30 and the safety push sheet 20 both protrude out of the staple exit 12. Next, under the action of the restoring force of the spring 44, the control knob 40 will be pushed back to continue moving along the third segments 53 until the disc portion 41 touches the side wall of the inner chamber 11. At this moment, the guide sheet 30 is positioned while protruding out of the staple exit 12 for making the staple gun exert a staple-floating function.

Further as shown in FIGS. 1, 8 and 12 which illustrate how the staple gun of the present invention exert the staple-floating function, the guide sheet 30 protrudes out of the staple exit 12 while the safety push sheet 20 still protrudes longer than the guide sheet 30, so that even through the staple gun of the present invention is in a staple-floating operation state, the safety push sheet 20 is still brought into contact with the appointed surface first. Therefore, the counter-acting force of contacting the appointed surface will cause the safety push sheet to move upwards as shown in FIGS. 3-4 in such a manner that the engaging slot 22 moves upwards along the linkage sheet 32 without moving the guide sheet 30, thus making the triggering sheet 24 touch the starting piece 251 successfully. At this moment, the switch 25 will transmit the staple-discharging signal, and then the user can trigger the staple gun to discharge the staples out of the staple gun. With the help of the guide sheet 30, the staples will protrude from the appointed surface while being positioned to offer the staple-floating fixing function. Therefore, when the staple gun is operated to exert the staple-floating function, the safety device 200 will move with the safety push sheet 20 to keep a safe distance between the guide sheet 30 and the safety push sheet 20, even through the guide sheet 30 protrudes out of the staple exit 12.

While we have shown and described various embodiments in accordance with the present invention, it is clear to those skilled in the art that further embodiments may be made without departing from the scope of the present invention.

What is claimed is:

1. A staple gun with a safety device comprising: a housing having a staple exit in a bottom thereof and an inner chamber adjacent to the staple exit, a safety device and a staple-floating unit, the safety device and the staple-floating unit being disposed inside the inner chamber; wherein:

the safety device includes a safety push sheet and a switch, a lower end of the safety push sheet extends out of the staple exit, in a middle portion of the safety push sheet is defined an engaging slot along a staple-discharging direction, the safety push sheet is further provided with a triggering sheet at an upper end thereof, the inner chamber is provided with a switch corresponding to the triggering sheet in such a manner that the contact moves upwards with the safety push sheet to turn on the switch to transmit a staple-discharging signal;

the staple-floating unit includes a guide sheet, a control knob, a positioning pin, one end of the guide sheet extends out of the staple exit, a middle portion of the guide sheet is provided with a linkage sheet for penetrating the engaging slot, the other end of the guide sheet cooperates with the safety push sheet to pull both ends of an elastic element in such a manner that the safety push sheet is movably connected to the guide sheet, the guide sheet is provided with a pair of fins above the elastic element, each of the fins includes an elongated transverse hole for penetration of the positioning pin; and the housing is defined with an insertion hole corresponding to the staple-floating unit in such a manner that the control knob is elastically installed in the insertion hole to advance/retreat along the elongated hole, the control knob is located between the two fins, the control knob is defined with a through hole in alignment with the elongated hole for penetration of the positioning pin, both ends of the positioning pin, which penetrate the guide sheet, are limited by the housing, so that the control knob is guided to extend/retract along the elongated hole, and the positioning pin drives the safety push sheet and the guide sheet to move up and down to enable the safety push sheet and the guide sheet to protrude out of the staple exit.

2. The staple gun with a safety device as claimed in claim 1, wherein the safety push sheet is located above the engaging slot on an end of the safety device, which hooks at one end of the elastic element, and the guide sheet is formed with a pull hook to hook at the other end of the elastic element, the triggering sheet of the safety push sheet is elongated and located at one side of the elastic element while avoiding the control knob, the switch is a micro switch and provided with a starting piece at one side thereof to trigger the triggering sheet, the switch is located in a seat which is located on a side wall of the inner chamber.

3. The staple gun with a safety device as claimed in claim 1, wherein the control knob of the staple-floating unit includes an elliptic disc portion and a knob portion protruding from a center of the disc portion, the disc portion is located on the side wall of the inner chamber, the knob portion protrudes out of the insertion hole, the disc portion is provided with a lateral portion protruding from one side thereof opposite the guide sheet, and a pillar portion protruding toward a back side of the guide sheet, the lateral portion of the disc portion is defined with a transverse through hole, the pillar portion and one side of the guide sheet hook at both ends of a spring to enable the control knob to elastically move along the elongated hole of the guide sheet.

4. The staple gun with a safety device as claimed in claim 1, wherein the housing is further provided with two limit grooves for insertion of the positioning pin, the limit grooves are defined in inner walls of two half-housing bases of the housing, each of the limit grooves in the form of a laterally-opened U-shaped groove and includes three segments: a first segment which is transversely arranged at an upper side of the limit groove, a second segment which is longitudinally arranged in a middle portion of the limit groove, and a third segment which is transversely arranged at a lower side of the limit groove and parallel to the first segment, the second segment is in a vertical communication with the first segment and the third segment.

5. A safety device for a staple gun comprising: a safety push sheet and a switch; wherein the safety device is disposed inside a housing of a staple gun where a staple-floating function is disposed, a lower end of the safety push sheet extends out of a staple exit of the staple gun, a middle portion of the safety push sheet is defined with an engaging slot along a staple-discharging direction, a triggering sheet extends from an upper end of the safety push sheet, the housing is provided with a switch corresponding to the triggering sheet in such a manner that the triggering sheet moves up and down to turn on the switch to transmit a staple-discharging signal;

the staple-floating unit includes a guide sheet, a control knob, a positioning pin, one end of the guide sheet extends out of the staple exit, a middle portion of the guide sheet is provided with a linkage sheet for penetrating the engaging slot, the other end of the guide sheet cooperates with the safety push sheet to pull both ends of an elastic element in such a manner that the safety push sheet is movably connected to the guide sheet, the guide sheet is provided with a pair of fins above the elastic element, each of the fins includes an elongated transverse hole for penetration of the positioning pin; and the housing is defined with an insertion hole corresponding to the staple-floating unit in such a manner that the control knob is elastically installed in the insertion hole to advance/retreat along the elongated hole, the control knob is located between the two fins, the control knob is defined with a through hole in alignment with the elongated hole for penetration of the positioning pin to drive the guide sheet to move up and down to enable the safety push sheet and the guide sheet to protrude out of the staple exit.

* * * * *